United States Patent [19]

Ruff

[11] 4,085,861

[45] * Apr. 25, 1978

[54] INSULATING DRINK-THROUGH CLOSURE LIDS FOR POTABLE OPEN-TOP CONTAINERS

[76] Inventor: Stanley L. Ruff, 9 Arbor Dr., New Rochelle, N.Y. 10804

[ * ] Notice: The portion of the term of this patent subsequent to Feb. 17, 1993, has been disclaimed.

[21] Appl. No.: 645,567

[22] Filed: Dec. 31, 1975

Related U.S. Application Data

[63] Continuation-in-part of Ser. No. 434,649, Jan. 18, 1974, Pat. No. 3,938,695.

[51] Int. Cl.[2] ..... A47G 19/22

[52] U.S. Cl. ..... 220/90.4; 220/90.6; 222/527; 222/565; 229/7 R; 229/43

[58] Field of Search ..... 220/90.2, 90.4, 90.6, 220/266, 268, 9 F; 215/347; 229/43, 7 R; 222/480, 565, 527

[56] References Cited

U.S. PATENT DOCUMENTS

| | | | |
|---|---|---|---|
| 2,534,614 | 12/1950 | Michael | 220/90.4 |
| 2,646,200 | 7/1953 | Atkins | 220/90.2 |
| 2,765,639 | 10/1956 | Bryant | 220/90.4 |
| 3,076,584 | 2/1963 | Sherlock | 220/266 |
| 3,171,580 | 3/1965 | Davis et al. | 220/268 |
| 3,625,785 | 12/1971 | Holmstrom et al. | 220/9 F |
| 3,730,399 | 5/1973 | Dibrell et al. | 220/90.4 |
| 3,739,976 | 6/1973 | MacDaniel | 229/43 |
| 3,797,696 | 3/1974 | Dibrell | 220/90.4 |
| 3,806,023 | 4/1974 | Barnett | 220/90.4 |
| 3,868,043 | 2/1975 | Freemyer | 220/90.4 |
| 3,917,100 | 11/1975 | Dukess | 215/347 |

*Primary Examiner*—George E. Lowrance
*Assistant Examiner*—Allan N. Shoap
*Attorney, Agent, or Firm*—Kirschstein, Kirschstein, Ottinger, Frank & Cobrin

[57] ABSTRACT

A drink-through closure lid for hot potable open-top containers, in which at least the portion of the lid that is in contact with the inner surface of a user's upper lip during the imbibing of the hot potable is composed of heat insulating material or an insulating layer to prevent harm or discomfort to the drinker.

5 Claims, 10 Drawing Figures

FIG. 5
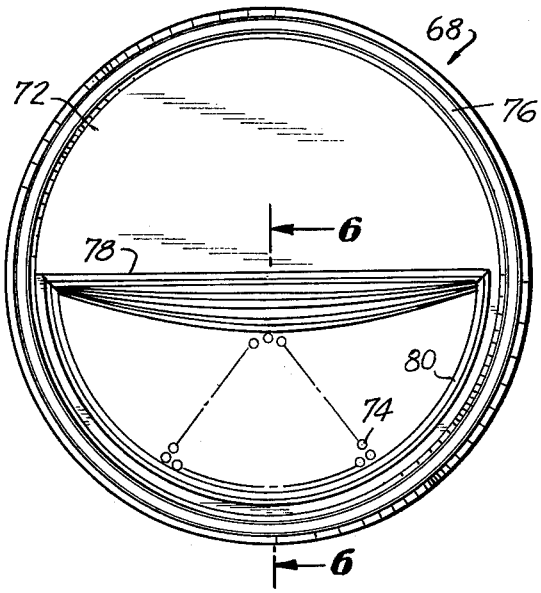
FIG. 6
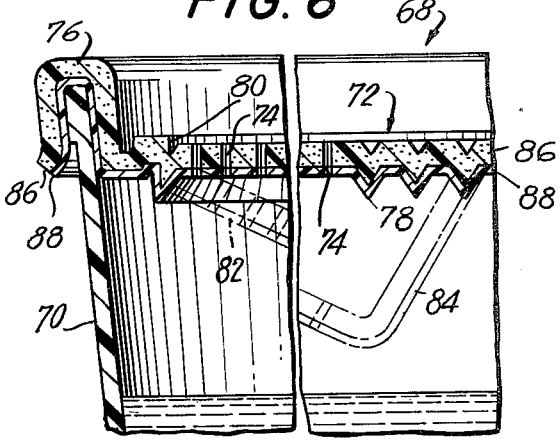
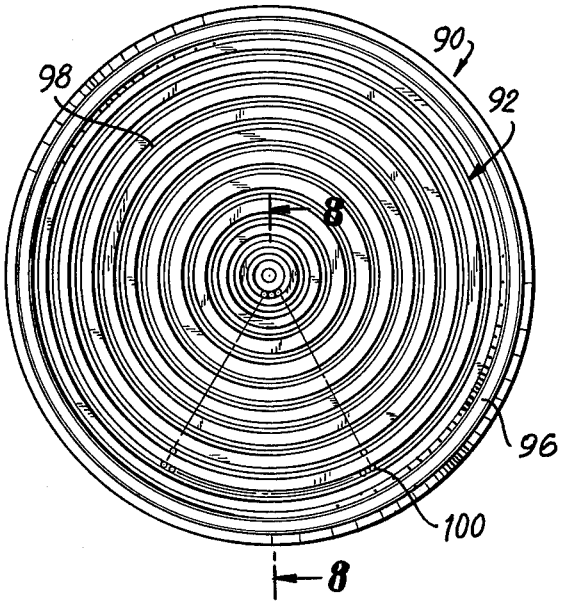
FIG. 7
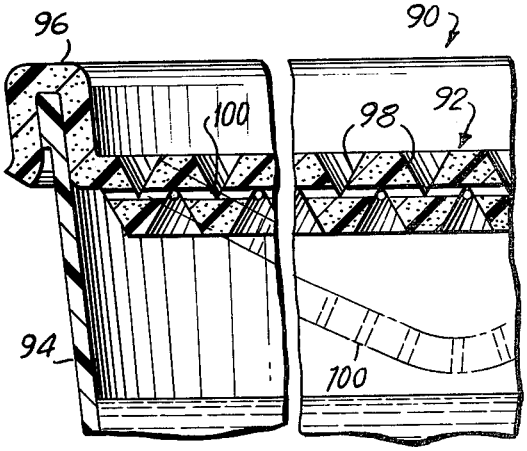
FIG. 8
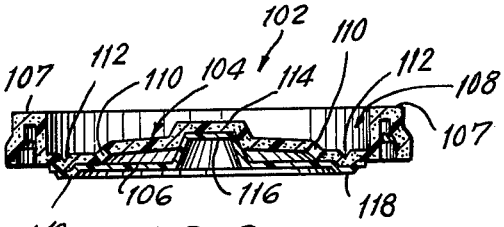
FIG. 9

INSULATING DRINK-THROUGH CLOSURE LIDS FOR POTABLE OPEN-TOP CONTAINERS

The present application is a continuation-in-part of U.S. Patent application Ser. No. 434,649 filed Jan. 18, 1974, now U.S. Pat. No. 3,938,695.

CROSS-REFERENCE TO RELATED APPLICATION

The present application is an improvement over the drink-through slosh-inhibiting closure lid for potable open-top containers described in U.S. Patent application Ser. No. 434,649 filed Jan. 18, 1974 and now U.S. Pat. No. 3,938,695, issued Feb. 17, 1976.

BACKGROUND OF THE INVENTION

1. Field of the Invention

A disposable closure lid for an open-top hot potable container. The closure lid, although removeably secureable to the container top, is designed and intended to be left in place when the container is carried about and when drinking therethrough. The lid is so constructed that a hot potable in the container can readily be drunk through the lid without harming sensitive areas of the drinker's upper lip, especially the inner surface of the upper lip, and the nose, especially the tip of the nose.

2. Description of the Prior Art

Open top containers from which potables are drunk are ubiquitous items. Since they frequently are employed to carry beverages from a place of dispensal to a place of consumption and since, when carried about or even when moved in the area of consumption, e.g., aboard common carriers such as planes, buses and railroad cars, they are subject to sudden movement which may cause some of the beverage to slosh out of the containers, it is common to furnish containers with a supply of lids that are utilized to close the containers. The lids most usually employed are imperforate and must be removed to allow the beverage to be drunk. Some lids are formed with a single tiny opening, usually centrally located, to act as a vent. Other lids are formed with cruciform slits or an incomplete annular slit, both of these are designed to permit insertion of a drinking straw. Some lids have been proposed that include a valved opening in the lid. However, lids that are removed for drinking cannot prevent escape of the beverage by sloshing and lids that are used with straws need straws to be supplied and, moreover, do not provide the user with the kind of oral satisfaction to which he has become accustomed through long usage by virtue of drinking over the rim of a cup or the like and do not provide the added satisfaction of inhaling the aroma of the beverage which is an ingrained secondary concomitant of drinking a fragrant beverage.

An improved drink-through slosh-inhibiting closure lid for potable open-top containers is disclosed in copending U.S. Patent application Ser. No. 434,649 filed Jan. 18, 1974, now U.S. Pat. No. 3,938,695. The disclosed lid entails inter alia the provision of a limited area in the crown of the lid which has a group of small openings to permit the potable to be drunk through the lid. Other drink-through lids are disclosed in U.S. Pat. Nos. 2,119,502; 2,765,639; 3,018,024; 3,730,399; 3,797,696 and 3,727,808.

One problem encountered in usage of drink-through closure lids involves the imbibing of hot liquids such as hot coffee, tea, chocolate or soup, since with this type of lid certain sensitive areas of the drinker's face may inadvertently come in contact with the outer surface of hot drink-through lid to the user's discomfort and possible hurt. A most sensitive area is the inner surface of the upper lip. This area of the mouth commonly comes in contact with the top surface of the lid when drink-through closure lids are used. Another area of the face which may come in contact with the lid is the nose, especially the tip of the nose.

The lid becomes hot when the container is tilted to cause egress of the hot liquid through the openings in the lid and into the mouth.

Drink-through lids such as described above are composed of the same material of construction as the container itself, e.g., various plastics or paper. The commonly used plastics for lids are such synthetic plastics as polyvinyl chloride, polyvinyl acetate, polyethylene, polypropylene, high impact polystyrene i.e., a copolymer of butadiene and styrene, polystyrene, polycarbonates, and ABS, an acrylonitrile-butadiene-styrene copolymer.

SUMMARY OF THE INVENTION

1. Purposes of the Invention

It is an object of the present invention to provide an improved drink-through closure lid for hot potable open-top containers.

Another object is to provide such a lid which is heat-insulating in nature.

A further object is to provide a drink-through closure lid of the character described which effectively prevents the burning of sensitive areas of the face when a hot potable is being drunk from an open-top container having such a lid affixed.

An additional object is to provide a heat-insulating drink-through closure lid for hot potable open-top containers.

These and other objects and advantages of the present invention will become evident from the description which follows.

2. Brief Description of the Invention

In the present invention, an improved closure lid for detachably capping the open top of a potable container containing a hot potable such as coffee, tea or soup is provided with one or more drink-through openings. The closure lid is generally characterized by the provision of a heat-insulating layer of a suitable material which is laminated over all or a portion of the top surface of the lid. The heat-insulating layer preferably is composed of a foamed synthetic plastic such as foamed polystyrene, polyurethane, polyvinyl chloride, or the like. Typically the foamed synthetic plastic is laminated to solid polystyrene sheet. For instance, a polystyrene foam sheet first is extruded and rolled up. Then the roll is brought to an extruder which extrudes a solid polystyrene sheet, and the roll is unwound onto the solid polystyrene sheet at the same speed as the solid sheet is extruded. The heat of the freshly extruded hot sheet forms a fusion bond of foamed polystyrene laminated to solid polystyrene sheet or heat and pressure is applied to form the bond. The composite sheet then is passed to a die which stamps out the lid blank and forms it to the desired configuration. In an alternative procedure, the laminated (composite) sheet is formed by coextrusion of foamed and solid sheet material in physical adjacency; the two sheets then are brought together and a fusion bond is created in situ.

The lid per se as thus constructed is light-weight and inexpensive and is not noticeably thicker than the material of the so-called "hot-cups" which are made of expanded polystyrene.

In one alternative embodiment of the invention, as will appear infra, the lid is completely composed of a foamed synthetic plastic instead of laminated construction.

The lid preferably is fabricated by a forming operation from flat sheet material which may be either a single layer of heat insulating material, e.g., a foamed synthetic plastic or a laminated structure produced as described supra. When the lid is of a laminated structure the layer to which the foamed plastic is bonded may be of sheet material such as metal foil, or wax or resin impregnated paper, however, the material of choice is a solid layer of thermoplastic synthetic plastic. The forming method that is most desirable is thermoforming, which includes such standard industrial processes as vacuum forming and forming between a pair of dies, the sheet either being heated prior to forming or being heated by heat supplied by the dies themselves.

The thickness of the foamed synthetic plastic sheet is from about 0.1 to about 0.25 inch. This same thickness range generally applies to the overall thickness of the laminated sheet, in which case the typical thickness of the non-insulating lid portion will typically be on the order of 0.01 inch. These figures are given only by way of illustration inasmuch as the same may vary depending on the material of construction employed for a particular lid.

The lid includes a circular top wall, i.e., a crown and a skirt which depends from the periphery of the crown. The crown and/or rim are so formed that the like can be detachably secured to the open mouth of a container, such formation being conventional. The lid as so formed will frictionally constrictively grip the mouth of a hot beverage container. The rim of the crown is adapted to be engaged by the lips of a drinker in a fashion similar to lip engagment of the rim of a cup. If the container includes an internal annular groove a short distance below the lip, the crown may be provided with a matching outwardly projecting annular rib designed to engage the container groove. In addition or alternatively, the skirt may be provided with a radially inwardly projecting annular rib to engage the underside of the bead of the rim of the container if the container has such a bead. In summary, the periphery of the lid is provided with means for releasably sealingly engaging the lip of a container, so that when once emplaced, the lid will not be readily accidentally disengaged.

The crown of the lid is so constructed as to enable the lid to be usefully employed as a drink-through lid for hot potables, the crown including at least one opening for that purpose. Pursuant to the present invention the upper surface of the lid has a low heat conductivity over at least the portion of the crown to be engaged by the inner surface of the upper lip of a person drinking the hot potable in the container through the lid.

Generally, a plurality of small openings is provided, typically as a group of small through-openings in a limited area of the crown extending centrally inwardly from adjacent to the periphery of the crown. The size of the opening or openings is not critical nor need they all be of the same size. However, the openings should of course be of such size that the liquid can flow through them, i.e., the openings must be larger than the capillary dimensions. Typically, the openings will be circular and have a diameter in the range of about one sixty-fourth of an inch to about one-quarter of an inch. It will be evident that the opening or plurality of openings must not be excessively large, in order to discourage the flow through the openings of a surge or slosh wave of liquid.

A preferred pattern or configuration for the plurality of openings is within a limited area of the lid, which area is generally sectorial or segmental. The openings are spaced rather close to each other, typically one sixty-fourth to one quarter of an inch apart, in order to achieve the effect of free flow of the hot potable through the top wall during drinking, which is accomplished by placing or holding the container up to the open mouth and in contact with the lips, and tilting the container about a horizontal axis tangential to the periphery of the crown at the center of the arc defining the outer extremity of the limited area. Desirably the limited area extends far enough toward the center of the lid so that it will include a foraminous portion which is beneath the drinker's nostrils, thus enabling the person who is using the drink-through lid to drink the hot potable to enjoy the full aroma and fragrance issuing through such openings.

It is apparent from the foregoing that the provision of an upper surface of the lid having low heat conductivity, over at least the portion of the top surface of the crown of the lid engaged by the inner surface of the lip of a person drinking the hot potable in the container through the lid, serves to protect the inner surface of the person's lip against excessive temperature which could lead to discomfort or harm. As mentioned supra, the under or lower surface of the crown is in direct contact with the hot potable when the container is tilted during drinking, and becomes heated to the approximate temperature of the hot potable; however, the insulating nature of the crown as described supra serves to protect the drinker's upper lip and nose against excessive temperature. Thus, the primary advantage of the invention is that a drink-through lid is provided for the consumption of hot potables, which prevents the possibility of any discomfort or injury to the drinker's upper lip or nose due to excessive heating of these portions of the face while drinking the hot potable.

The lid of the present invention is generally characterized by those features mentioned supra, and thus another advantage of the invention is that the present lid improvement is generally applicable to all types of drink-through lid configurations.

The invention accordingly consists in the features of construction, combination of elements, and arrangements of parts which will be exemplified in the lids hereinafter described and of which the scope of invention will be indicated in the appended claims.

BRIEF DESCRIPTION OF THE DRAWINGS

In the accompanying drawings in which are shown various possible embodiments of the invention:

FIG. 5 is a top view of a lid on a container, the lid having a manually depressible semi-circular portion including a limited perforate area;

FIG. 6 is an enlarged fragmentary view taken substantially along the line 6—6 of FIG. 5, the solid lines illustrating the predepressed configuration and the dot-and-dash lines illustrating the post-depressed configuration;

FIG. 7 is a view similar to FIG. 5 of a lid with substantially the entire crown depressible into a conical configuration;

FIG. 8 is an enlarged fragmentary view taken substantially along the line 8—8 of FIG. 7, the solid and dot-and-dash lines having the connotations as in FIG. 6; and FIG. 9 is a cross-sectional view of an alternative nonspill drink-through lid configuration which has been provided in accordance with the present invention, the lid of FIG. 9 being in its normal closed configuration.

DETAILED DESCRIPTION OF THE PREFERRED EMBODIMENTS

Figures 1, 2, 2A, 3, 4:
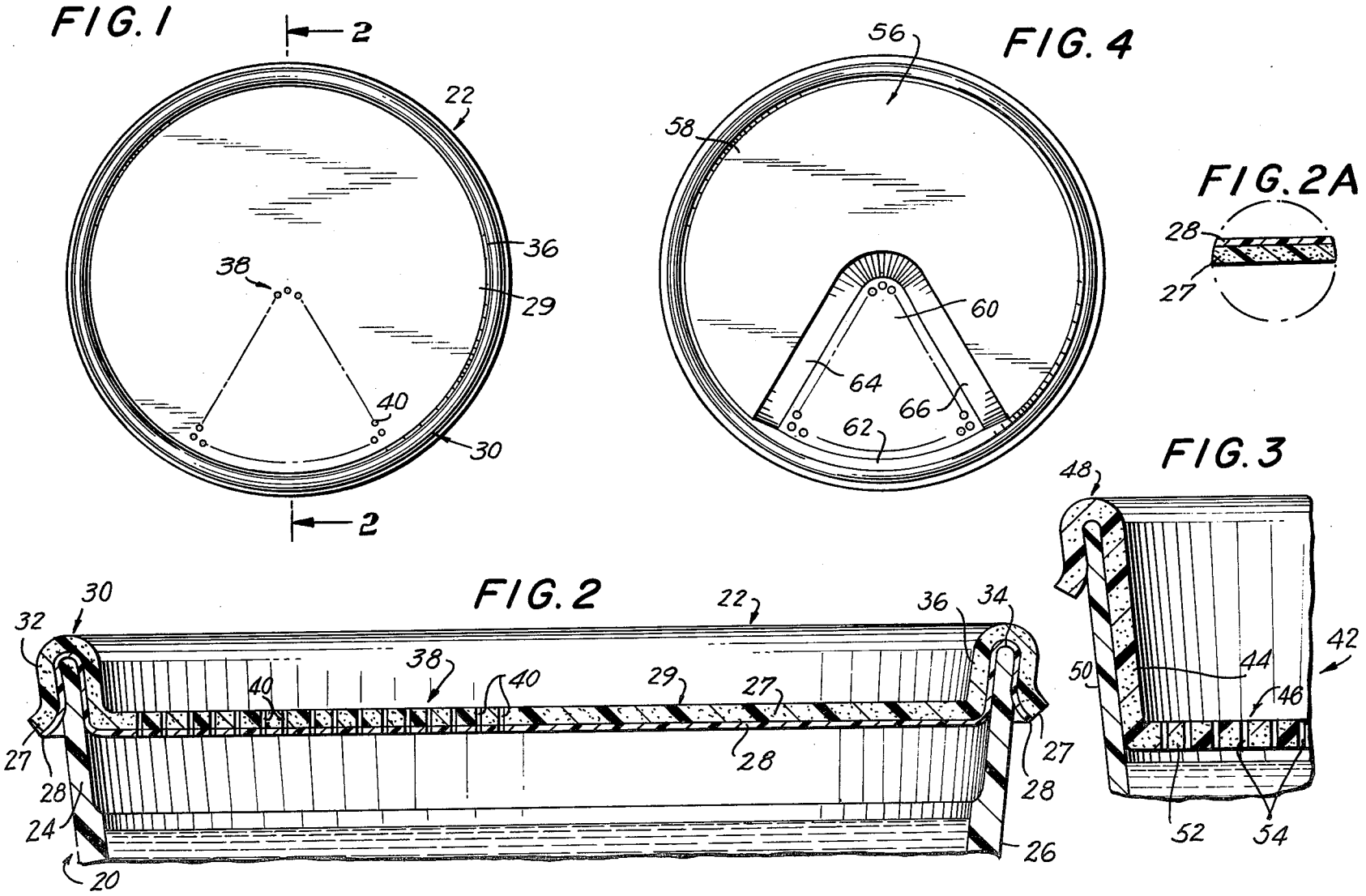
FIG. 1 is a top view of a lid of the present invention on a container, the lid being of a simple embodiment of the invention that includes a limited perforate area in the crown.
FIG. 2 is a fragmentary sectional view taken substantially along the line 2—2 of FIG. 1.
FIG. 2A is a partial elevation view which shows an alternative embodiment in which the insulating layer is below the layer of lid per se.
FIG. 3 is an enlarged fragmentary sectional view of a lid comparable to the lid of FIG. 1 except that the lid is modified to include a depressed crown, all of which is depressed to permit accommodation of the tip of a person's nose during drinking, the lid having the limited perforate area.
FIG. 4 is a top view of a lid on a container, the lid being modified to include a top wall or crown having a limited perforate area thereof depressed to accommodate the tip of a person's nose during drinking and also to provide inclined baffles for minimizing the heights of slosh waves.

Referring now in detail to the drawings, and more particularly to FIGS. 1 and 2, the reference numeral 20 denotes an open top container adapted to have a closure lid 22 detachably sealingly engaged to the lip or rim 24 of container 20. The container 20 is of any conventional configuration and construction. Typically, the container 20 has a circular open top and downwardly converging side walls 26, so that container 20 is generally of inverted frusto-conical contour, with a smaller closed bottom and a larger open upper end. Containers of this type may vary in sundry details, according to manufacturing equipment and desired functions, but they all have in common an open top which almost invariably is circular. The container may be fabricated from any acceptable material such as plastic sheet, wax or resin impregnated paper, or thin paperboard or the like. The lids of the present invention are designed with peripheral engaging means for releasably sealingly gripping the container lip, such means varying in detail to cooperate with differently constructed container lips.

The lid 22 is fabricated from a laminated sheet of plastic in accordance with the present invention so as to have a low conductivity of heat, with the lid 22 being characterized in this preferred embodiment of the invention by the provision of an upper layer 27 consisting of foamed plastic, laminated to a lower layer 28 consisting of solid plastic sheet.

The upper layer 27 is heat insulating in nature and assures that the top or upper surface of crown 29 of the lid 22 will be of low heat conductivity. The upper layer 27 may in practice alternatively consist of any of the alternative heat insulating materials mentioned supra.

The lower layer 28 will usually be a non-foamed plastic, although metal foil, or paperboard, or wax or resin impregnated paper may be used in suitable instances.

The lid 22 must be resilient, at least at its peripheral zone, to permit it to engage the open mouth of the container with a snap fit, so that the lid 22 can releasably sealingly engage the container mouth to enable the lid to be emplaced with ease and to resist accidental removal. Due to the pour-through or drink-through construction of the lid, it usually will not be desirable or necessary to remove the lid when it once has been secured to the container; however, if for some reason the lid is to be deliberately removed, it will not be any more difficult to do so than with a conventional lid having none of the features of the present invention, i.e., the lid includes a conventional peripherally disposed means for releasably sealingly engaging the lip of the container.

As an exemplification, the lid 22 has a circular crown 29, at the periphery of which is provided an integral bead 30 from which a skirt 32 depends, the bead is in the shape of an inverted "U", the base 34 of which is adapted to seat on the lip, i.e., upper edge, of the rim 24. One of the depending walls of the bead 30 constitutes the skirt 32. The other depending wall 36 of the bead 30 joins the bead to the periphery of the crown 29. The space between the opposed walls 32 and 36 is slightly less than the thickness of the rim 24, and, desirably, the walls 32 and 36 converge downwardly toward one another thereby to cause the bead to grip the rim when the lid is snapped on the container to close the open container mouth. The lower edge of the skirt 32 flares slightly outwardly to facilitate initiation of interengagement between the lid and the rim. The crown 29 is somewhat below the base of the bead 30, this not being critical.

The drink-through feature of the lid 22 entails the provision of a limited area 38 of small openings 40, each of which extends completely through the crown 29, i.e., through both layers 27 and 28. The remainder of the crown 29 is imperforate. Conveniently, in any given lid, e.g., the lid 22, all of the openings are of the same size. However, it is within the scope of the invention for the openings to vary in size in the same lid, or for a single opening to be provided. The openings should be large enough for liquid to flow freely through them when a container with a lid thereon is tilted to raise the surface of the liquid to above that of at least a portion of the area 38. Thus, the openings should be larger than capillary.

A typical minimum size of opening is about 1/64 inch, assuming circularity. On the other hand, the openings should not be too large, because enough wall structure must remain, and also because the openings must be small enough to discourage flow through the openings of a surge or slosh wave of hot potable in a lidded container. A suggested maximum size of opening is about one fourth inch, assuming circularity. It should be understood that the opening or openings may be of any configuration whatsoever, circularity being mentioned simply because a circular shape is the easiest, least expensive and most desirable for tooling purposes, i.e., for the provision of punches that will be used to cut out the openings. When different sizes of openings are used in a given lid, the larger openings usually will be located adjacent the bead 30, i.e., where the hot potable largely will flow through the lid when imbibed from the container, and the smaller openings will be located further from the bead where vapor from the hot potable will seep through the lid to allow the escape of aroma which will enhance the pleasure to be derived from drinking the hot potable.

Referring now to FIG. 3, a heat insulating lid 42 is shown which differs from the lid 22 previously described in that there is an increase in length of the depending inner wall 44 with a corresponding lowering of the crown 46 with respect to the bead 48. An excellent depth for the crown is about one half to about three fourths inch which allows the container 50 to be manipulated naturally, as described above, during drinking without having the tip of the drinker's nose strike the crown. Even if this happens, no adverse effects to the tip of the nose will occur, since the lid 42 is provided with an upper surface of low heat conductivity. In this case lid 42 is composed entirely of foamed plastic rather than being laminated to a non-foamed substrate. The crown 46 has a limited perforated area 52 containing openings or holes 54 which extend vertically through the crown 46. The area 52 is the same as the area 38, serves the identical function and is of the same construction. It is to be noted that the entire crown 46 is depressed to the same height.

FIG. 4 shows another lid 56, the configuration of which is much like that of the lid 42 in that the crown 58 is depressed for admission of the tip of a nose during drinking, but unlike the lid 42, the crown is depressed for less than its entire area, in particular, for an area coextensive with or somewhat larger than the limited perforated area 60. Except for the limited depressed perforated area 60, the lid 56 is comparable to the lids 22 and 42 in that the entire top surface of the crown 58, in particular the top surface of the area 60, is a surface of low heat conductivity, the area 60 being the portion of the top surface of crown 58 which is engaged or engageable by the inner surface of the lip of a person drinking the hot potable in the container through the lid. The depressed limited perforated area 60 is connected to the higher level remaining portion of the crown 58 by walls 62, 64 and 66. The wall 62 is adjacent the side wall of the container. The walls 64 and 66 join the radial edges of the sectorial area 60 to the remainder of the crown 56. These walls likewise are formed of a material of low heat conductivity.

In addition to having the area 60 depressed below the level of the balance of crown 58 for the purpose mentioned, the walls 64 and 66 serve a further purpose in that they act as baffles to dampen slosh waves of the potable in the container. These walls 64 and 66 extend downwardly toward the surface of the hot potable in the container, so that they interfere with free movement of slosh or surge waves across the surface of the hot potable toward the depressed perforated limited area 60 and, in so doing, the walls 64 and 66 lower the level of the wave that enters the depressed area. This dampening of slosh waves is enhanced by inclination of the side walls 64 and 66 upwardly and outwardly from the area 60, since waves striking these walls tend to rebound at a downward angle, so as to lessen the energy of the slosh waves impinging on said walls. The side walls 64 and 66 preferably are imperforate to maximize this effect. However, the wall 62 may be perforate or imperforate. The provision of perforations in the wall 62 assists the ease with which a drinker can imbibe through the lid 56.

It will be appreciated that the provision of a prefabricated entirely depressed crown or a crown with a prefabricated depression over only the limited perforated area, resulting in a lid higher than a conventional lid with a limited perforated area, may make compact stacking of the lids more difficult to accomplish and result in a higher stack for the same number of lids. To minimize the aforementioned problems, a still more sophisticated version of lids is provided, the same being shown in FIGS. 5, 6, 7, and 8, which constitute lids of normal height for manufacture, stacking, storage, shipping, sale and application to containers, in which the limited perforated area is manually depressed by the application of downward pressure to the crown so as to form a depression to accommodate the nose of a person drinking the hot potable from the container through the lid. In other words, such lids have a depressible perforated area, i.e., a perforated area that, as made, handled, sold and applied to a container, is in or slightly below the plane of the periphery of the lid; but which can be readily manipulated to shift the same into a desired depressed position.

Referring now to FIGS. 5 and 6, a lid 68 is shown that embodies this sophisticated version of drink-through lid. The lid 68 is coupled to a container 70 with a conventional peripheral coupling means such as described previously. Lid 68 has a crown 72 slightly below the rim of the open mouth of the container, the height of the crown 72 being such that it would be in the path of the tip of the nose of a drinker who tried to drink a hot potable in a normal fashion from the container 70 with liquid flowing into his mouth through an opening or a limited perforated area in the lid 68. The present construction of the crown 72 permits this area to be depressed manually, so as to transform the crown 72 into a shape that will accommodate the tip of the nose during drinking.

The crown 72 has a limited perforated area 74 of wedge shape extending from adjacent the bead 76 of the lid to adjacent the center of the lid. The crown 72 is provided during its thermoformation, as with the aid of dies, with a series of pleats, i.e., flutes 78. The flutes 78 are close together and approximately parallel to each other, and are also approximately parallel to a diameter perpendicular to the median radial line of the area 74. An optimum arrangement is shown with one flute at this diameter, and the remaining flutes (two additional flutes are illustrated although more or less may be employed in practice), on the area side of the diametral pleat. The additional flutes are slightly bowed toward the foraminous area 74. The material of the crown is flexible whereby, if manual pressure is applied to the area 74 or to the crown in the vicinity of the area 74, this area and the adjacent part of the crown on the same side of the flutes will be depressed and will remain depressed after the pressure is released. An additional peripheral flute 80 may be included, which flute 80 is of semi-circular plan contour and located with its ends at the end of the diametral flute and its arch next to the bead 76, crossing the wide portion of the wedge shaped area 74. The flute 80 likewise expands when the above mentioned manual pressure is applied and remains extended when the pressure is released. The depths of the various flutes are sufficient so that when they are expanded, the semi-circular portion of the crown 72 including the area 74 assumes a trough-shaped configuration as shown by the dot-and-dash line position illustrated in FIG. 6. The deepest portion of the trough is near the center of the lid and is sufficiently deep to accommodate the tip of a drinker's nose. The configuration of the crown 72 before application of manual pressure is indicated by the solid lines in FIG. 6. It will, of course, be apparent that the formation of the trough serves to inhibit slosh waves in a manner comparable to the FIG. 4 embodiment described supra. It should be noted that the trough of FIG. 6 includes an inclined wall 82 sloping centerward from the bead 76 and an almost vertical wall 84 extending downwardly across about the center of the lid. The foraminous area 74 is in the moderately inclined wall 82.

It will be appreciated that the depth of the lid 68 prior to manual depression, is about that of the lid 22 so that the lids 68 can be stacked to about the same height as conventional lids. The flutes 78 and 80 of juxtaposed lids interfit nicely so as not to noticeably increase the height of the stack. It is to be understood that once the flutes are expanded, there is neither intent nor need to have them restored to their contracted position, inasmuch as the lid 68 is disposable along with the container 70 after the hot potable in the container has been consumed.

In accordance with the present invention, and referring specifically to FIG. 6, the lid 68 is of laminated structure and cross-section comparable to the laminated structure of lid 22, e.g., the lid 68 is composed of an upper foamed plastic layer 86 laminated to a lower solid plastic layer 88, so that an upper lid surface of low heat conductivity is provided over at least the foraminous area 74 and generally over adjacent areas of the crown 72, e.g., over depressed area 82 or even over the entire upper surface of the crown 72, so that at least the portion of the top surface of the crown 72 which is engaged by the inner surface of the lip of a person drinking the hot potable in the container through the lid, does not exert deleterious heating effects on the inner lip surface, as described supra.

Referring now to FIGS. 7 and 8, there is shown a lid 90 embodying a variant of the lid 68 and which, like the lid 68, is depressible upon the application of manual pressure to be transformed from a horizontal crown position as shown in solid lines in FIG. 8 to a downwardly conical crown position as shown in dot-and-dash lines in the same figure. The lid 90 has a crown 92 which, as sold and coupled to a container 94, is essentially horizontal and slightly below the level of the bead 96 of this lid.

The crown 92 is formed to include several concentric circular flutes 98. The flutes 98 may be close together, as depicted, or somewhat spaced. Their mutual spacing and the depths of the flutes are such that upon the application of pressure the crown 92 will assume a conical shape that is deep enough at its center to accommodate the tip of a person's nose while the person is drinking from the container through the lid. The crown 92 is foamed with a limited perforated area 100, which is the same as the areas previously detailed, serves the identical function and is of the same construction; that is to say, hot liquid will flow through the area into a consumer's mouth for drinking and the inclined walls of the conical depression, both the perforate and imperforate portions thereof, will act as baffles to dampen slosh waves. The openings are essentially blocked by opposed flute walls in the non-depressed condition of the crown 92. In accordance with the present invention, and referring specifically to FIG. 8, the lid 90 is composed of a continuous layer of foamed plastic comparable to the FIG. 3 embodiment described supra.

Referring now to FIG. 9, which is a configuration of drink-through lid comparable to that shown and described in U.S. Pat. No. 3,730,399, but modified in accordance with the present invention, the lid 102 is characterized by the provision of a cover section generally designated as 104 and a closure section generally designated as 106. Cover section 104 contains a re-entrantly shaped rim section 107 which can be of the type used on conventional lids for press-fitting the rim of a container, not shown, with a snap-fit to hold the cover section 104 on a container. Cover section 104 and a closure section 106 are usually circular in configuration and cover section 104 is formed of foamed plastic or the like insulating material to provide an upper surface of low heat conductivity in accordance with the present invention, while closure section 106 is preferably formed of a solid thermoformed plastic sheet material. Cover section 104 is more elastic than closure section 106, so that when pressure is applied to cover section 104, it will undergo elastic deformation while closure section 106 will undergo relatively little elastic deformation.

Immediately inside rim 106 of cover section 104 is a relatively deep annular well 108. Within well 108, there is a plurality of openings 110, usually located on a common diameter. Well 108 also contains an annular reinforcing rib 112 on a diameter greater than that of openings 110. The rib 112 also serves the further function of a sealing projection.

Cover section 104 has a raised central portion 114 in the external form of a button. Closure section 106 is concentric with cover section 104 and has a raised central portion 116 which is joined to the raised central portion 114 of cover section 104 as by bonding or by welding with a suitable adhesive. Cover section 104 and closure section 106 are accurately located relative to one another during assembly of the lid. The closure section 106 also has an annular reinforcing and sealing rib 118 near its periphery. Annular reinforcing ribs 112 and 118 have the same diameter so that they will fit into each other when the closure section is in its non-drink-through position, to form a fluid-tight annular seal.

Closure section 106 is a continuous member having an outside diameter less than the inside diameter of the container so that there is always a space between the periphery of section 106 and the inner wall of the container. The outer diameter of closure section 106 is further dimensioned to be slightly greater than the diameter of the lowest portion of well 108 of cover section 104.

The closure section 106 is so configured that in unstressed condition of the cover section the periphery thereof contacts the bottom of annular well 108 at an annular region located on a diameter of greater dimension than the diameter between opposed openings 110. Specifically, this contact takes place between ribs 112 and 118 and surfaces adjacent thereto. As a result of such contact, a fluid-tight seal is obtained.

When the cover section is stressed by downwards pressure on the button 114, the closure section 106 is moved downwards away from the bottom of annular well 108. Hot potable can now flow from the lid of the tilted container, first through the space between the periphery of closure section 106 and the inner wall of the container, then through the space now separating the peripheries of the two sections and then through openings 110 and into annular well 108. The user then drinks the hot potable at any peripheral portion of rim 106 and hot potable will continue to flow into well 108, until exhausted, so long as cover section 104 is depressed. Alternatively, the user may drink the hot potable directly from openings 110.

Since cover section 104 is composed of a foamed plastic or the like, an upper surface of low heat conductivity is provided over the portion of the top surface of lid 102, specifically the portion of the top surface of cover section 104 which is engaged by the inner surface of the lip of a person drinking the hot potable in the container through the lid.

It thus will be seen that there are provided closure lids for capping the open top of a hot potable container which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. A drink-through closure lid for detachably capping the open top of a hot potable container, said lid having a crown and peripheral means for releasably sealingly engaging the lip of the container, means providing at least one opening in the crown through which the hot potable in the container may be drunk through the lid, while the lid is in container-capping position, and means providing an upper surface of low heat conductivity over at least the portion of the top surface of said crown engaged by the inner surface of the lip of a person drinking the hot potable in the container through the lid, said lid being provided with flutes juxtaposed with the means providing at least one opening in the crown and being expandable downwardly upon application of manual downward pressure to the crown whereby to form a depression to accommodate the nose of a person drinking the hot potable from the container through the lid.

2. The lid of claim 1, in which the flutes are parallel to a diameter of the crown.

3. The lid of claim 2, in which the depression formed by pressing on the crown is in the shape of a trough.

4. The lid of claim 1, in which the flutes are in the configuration of concentric circles.

5. The lid of claim 4, in which the depression formed by pressing on the crown is conical.

* * * * *